US008172422B2

(12) United States Patent
Kim

(10) Patent No.: US 8,172,422 B2
(45) Date of Patent: May 8, 2012

(54) LAMP DEVICE

(75) Inventor: Duk-Yong Kim, Gyeonggi-do (KR)

(73) Assignee: KMW USA, Inc, Fullerton, CA (US)

( * ) Notice: Subject to any disclaimer, the term of this patent is extended or adjusted under 35 U.S.C. 154(b) by 378 days.

(21) Appl. No.: 12/507,181

(22) Filed: Jul. 22, 2009

(65) Prior Publication Data

US 2010/0220470 A1 Sep. 2, 2010

Related U.S. Application Data

(60) Provisional application No. 61/175,140, filed on May 4, 2009.

(30) Foreign Application Priority Data

| | | |
|---|---|---|
| Feb. 27, 2009 | (KR) | 20-2009-0002270 U |
| Mar. 9, 2009 | (KR) | 20-2009-0002673 U |
| Mar. 10, 2009 | (KR) | 20-2009-0002724 U |
| May 4, 2009 | (KR) | 20-2009-0005382 U |
| Jul. 9, 2009 | (KR) | 20-2009-0008880 U |

(51) Int. Cl.
*F21V 33/00* (2006.01)
*F21V 29/00* (2006.01)

(52) U.S. Cl. ..... 362/234; 362/253; 362/267; 362/294; 362/373

(58) Field of Classification Search ..... 362/231, 362/234, 253, 808, 124, 800, 294, 345, 373, 362/249.01–249.09, 249.1–249.19, 267, 362/158; 446/485
See application file for complete search history.

(56) References Cited

U.S. PATENT DOCUMENTS

| | | | | |
|---|---|---|---|---|
| 1,606,354 | A | 11/1926 | Fillion | |
| D186,719 | S | 11/1959 | Goldman et al. | |
| D359,816 | S | 6/1995 | Colarusso | |
| 5,577,831 | A | 11/1996 | Chang | |
| D470,964 | S | 2/2003 | Eiffert | |
| D505,228 | S | 5/2005 | Weiser et al. | |
| 7,182,477 | B1 * | 2/2007 | Hartz | 362/96 |
| 7,434,971 | B1 | 10/2008 | Wang | |
| 7,514,876 | B2 * | 4/2009 | Roach, Jr. | 362/184 |
| D598,156 | S | 8/2009 | Xiao et al. | |
| 2005/0157485 | A1 | 7/2005 | Shieh | |
| 2005/0248934 | A1 * | 11/2005 | Weiser et al. | 362/124 |
| 2007/0019405 | A1 | 1/2007 | Chang et al. | |
| 2009/0141494 | A1 * | 6/2009 | Zhang et al. | 362/249.03 |
| 2009/0154161 | A1 | 6/2009 | Parker et al. | |
| 2009/0168418 | A1 * | 7/2009 | Zheng et al. | 362/234 |
| 2009/0185376 | A1 * | 7/2009 | Yu | 362/253 |
| 2009/0268438 | A1 * | 10/2009 | Huang | 362/183 |
| 2010/0321930 | A1 * | 12/2010 | Watanabe et al. | 362/184 |

* cited by examiner

*Primary Examiner* — Bao Q Truong

(57) ABSTRACT

There is provided a lamp device including a housing having a plurality of radiation fins for heat radiation on a top surface portion thereof, a Light Emitting Diode heat (LED) substrate having a plurality of LEDs for emitting illumination light, and a cover formed of a transparent or semi-transparent light-transmitting material and installed to be engaged with the housing under the LED substrate, for protecting the LED substrate.

17 Claims, 12 Drawing Sheets

LAMP DEVICE

CLAIMS OF PRIORITY

This application claims priority from an application entitled "Lamp Device" each filed in the Korean Intellectual Property Office on Feb. 27, 2009 and assigned Serial No. 20-2009-0002270; filed on Mar. 9, 2009 and assigned Serial No. 20-2009-0002673; filed on Mar. 10, 2009 and assigned Serial No. 20-2009-0002724; filed on May 4, 2009 and assigned Serial No. 20-2009-0005382; and filed on Jul. 9, 2009 and assigned Serial No. 20-2009-0008880, and the contents of each which are hereby incorporated by reference in its entirety. This application also claims priority from U.S. provisional Application No. 61/175,140 filed on May 4, 2009, the contents of which are hereby incorporated by reference in its entirety; and U.S. design patent application Ser. No. 29/336,416 filed on May 4, 2009 and Ser. No. 29/338,544 filed on Jun. 12, 2009.

BACKGROUND OF THE INVENTION

1. Field of the Invention

The present invention generally relates to a lamp structure using Light Emitting Diodes (LEDs) as light sources. More particularly, the present invention relates to the structure of a lamp device for ensuring good heat radiation through distributed heat emission portions, providing a uniform flat fluorescent light source, and offering a pleasing appearance.

2. Description of the Related Art

In general, a lamp device used for outdoor purposes, mainly a street lamp, illuminates the surrounding area on dark or rainy days by turning the lamp on or off. The lamp preferably is installed high on a lamp post and uses commercial electrical power. There are several types of street lamps, including road lamps for illuminating roads at night from the sides of the roads, nightwatch lamps for preventing crimes, and garden lamps installed in parks or gardens for illumination and decoration purposes.

A variety of light sources are available for such lamp devices, such as high-pressure mercury lamps, fluorescent lamps, natrium lamps, etc. The recent trend is in favor of LED (light-emitting-diode) street lamps characterized by low power consumption, low heat emission, and high brightness. Such LED lamps overcome problems with heat emission and lamp life.

Typically, a ballast is installed inside the lamp device to supply power to the light source. In addition, a leakage breaker, a power controller, and the like are installed to the lamp device. The power controller, which may include a timer and a brightness sensor, controls power supply to the light source so that the light source emits light at a predetermined or higher luminance at night or other dark conditions.

A conventional LED lamp device is configured such that the LED light sources are concentrated in a predetermined small housing. Therefore, the conventional LED lamp device creates much glare and makes it difficult to obtain a uniform flat illumination like a fluorescent light source.

Moreover, because much heat is emitted, a heat radiator is additionally required. In many cases, the heat radiator is larger than the lamp device and has a poor appearance. Also, the conventional LED lamp device is limited to the function of a street lamp.

Meanwhile, a transceiver (including a relay) collects data for wireless terminals and transmits them to a switching network in a wireless communication system. The transceiver amplifies a transmission signal by use of a high-power amplifier within a body and radiates the transmission signal through an antenna device. The antenna device transmits a signal received from the wireless terminal to the transceiver for wireless communication, so that the received signal is processed. The antenna device is installed high on the rooftop of a building or on a tower and the transceiver is positioned within the building or under the tower.

In the wireless communication system, the antenna device is installed high to maximize the propagation distance of a radio signal. In an urban area, typically, a post is put up on the rooftop of a building, a fixture is mounted onto the post, and a communication antenna is installed to the fixture.

Although the antenna device for the wireless communication system should be installed at an appropriate position to enable reliable wireless communications, its site is hard to secure because the antenna device is considered as an obstacle to a living environment and thus is unwanted.

Especially in an urban area where people enjoy wireless communication services highly frequently, high cost is another obstacle to the siting of the antenna device.

Surveillance cameras are more unwelcome and thus difficult to install.

In the meantime, street lamps for illuminating roads and nightwatch lamps are installed to their separate posts downtown. Antenna devices, street lamps, nightwatch lamps, etc. are installed to separate posts although they commonly require a power supply and a communication function. Accordingly, there are too many unnecessary disfiguring posts downtown.

SUMMARY OF THE INVENTION

Therefore, an object of the present invention is to provide a lamp device for producing less glare by generating a uniform flat fluorescent light source.

Another object of the present invention is to provide a lamp device with excellent heat radiation effects.

A further object of the present invention is to provide a lamp device for changing a light projection angle.

Still another object of the present invention is to provide a lamp device for use as a street lamp.

Yet another object of the present invention is to provide a lamp device for use as a symbol of an organization, a facility, or a company.

To achieve the above object, there is provided a lamp device including a housing shaped into a structure representing an animal or object with wings. A plurality of heat radiation fins may be provided for heat radiation on a top surface portion corresponding to the outer sides of the wings. A Light Emitting Diode (LED) substrate is installed under the housing on the inner sides of the wings and has a plurality of LEDs for emitting light. A cover is engaged over the housing and is formed of a transparent or semi-transparent light-transmitting material to allow the light emitted from the LED substrate to pass and protects the LED substrate.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Embodiments of the present invention will be described in detail with reference to FIGS. 1 through 18.

Figure 1:
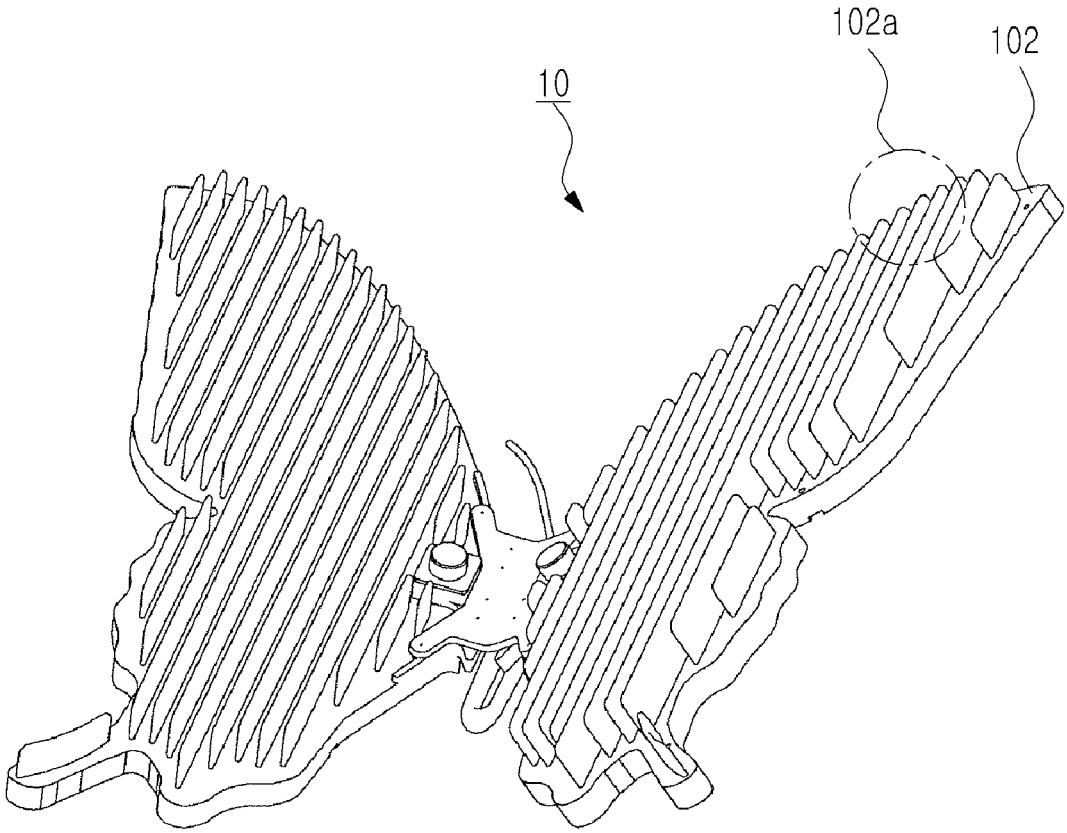
FIG. 1 is a perspective view of a lamp device according to an embodiment of the present invention.
Figure 2:
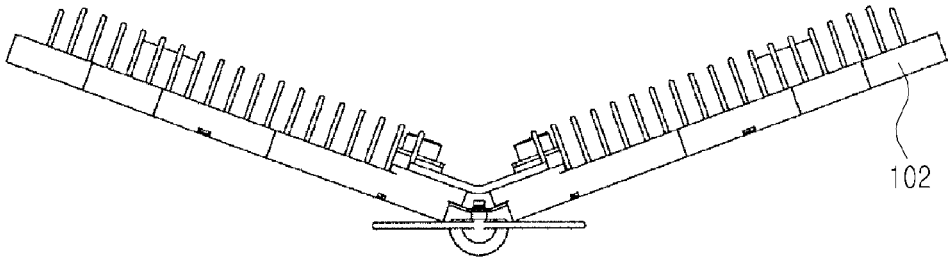
FIG. 2 is a frontal view of the lamp device illustrated in FIG. 1.
Figure 3:
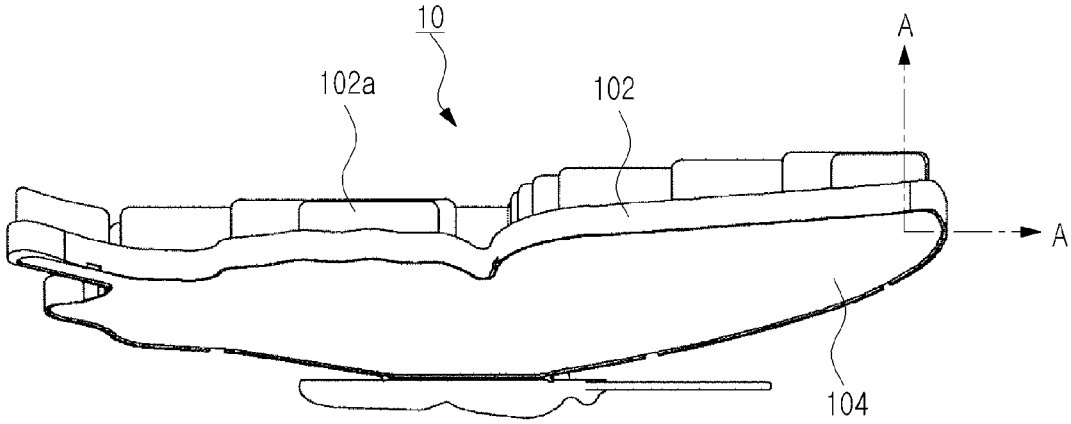
FIG. 3 is a left side view of the lamp device illustrated in FIG. 1.
Figure 4:
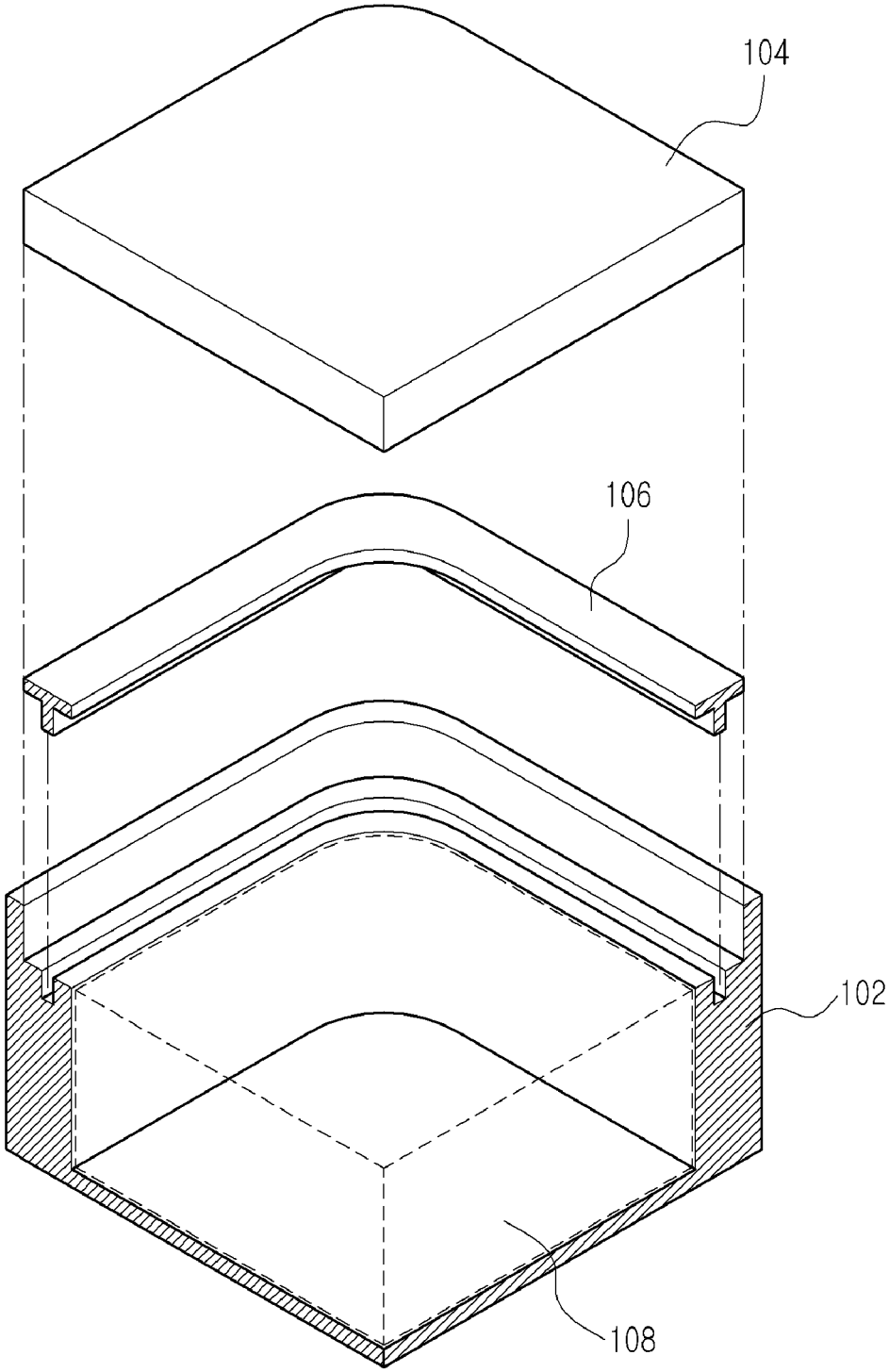
FIG. 4 is a sectional view of the lamp device illustrated in FIG. 3, taken along the line A-A'.
Figure 5:
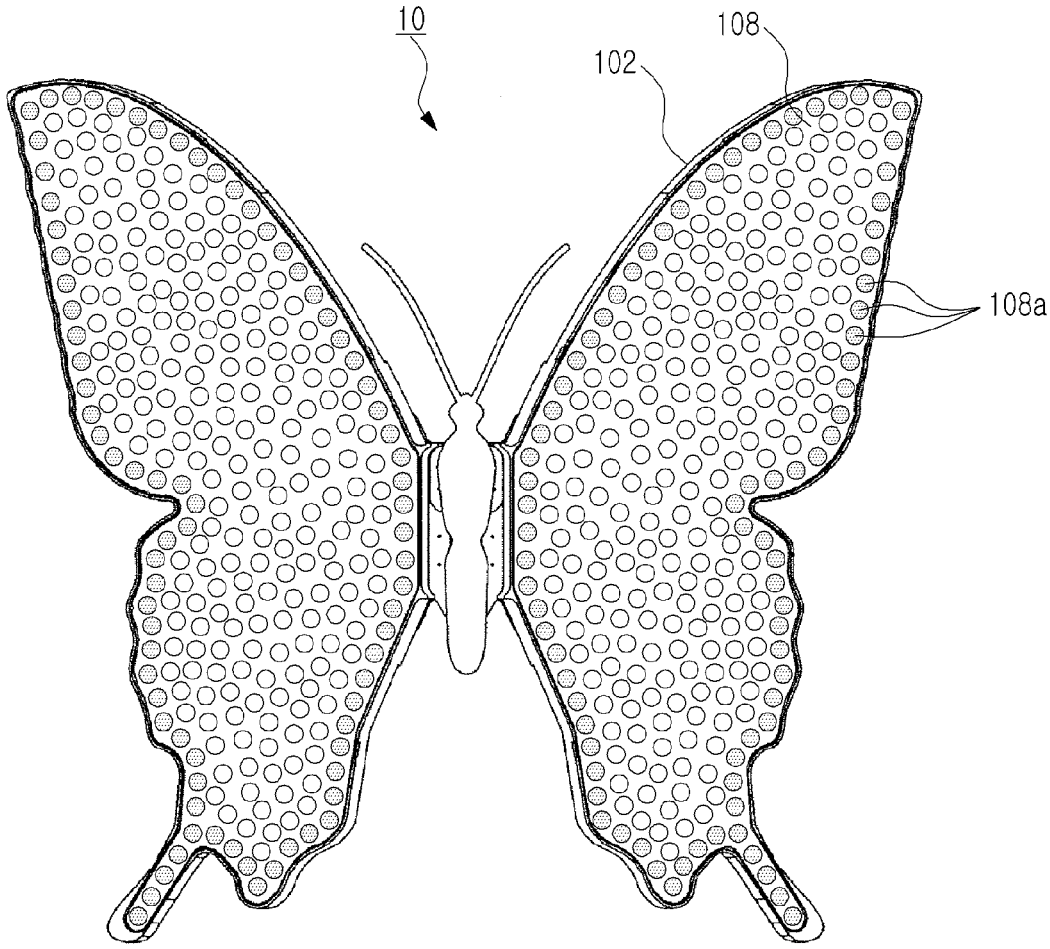
FIG. 5 illustrates a bottom structure of the lamp device illustrated in FIG. 1.
Figure 6:
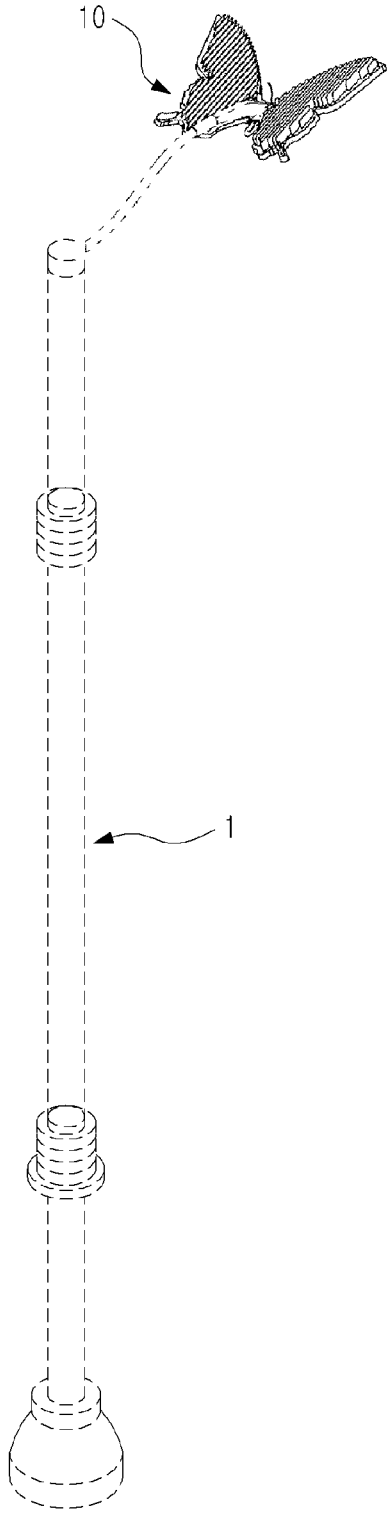
FIG. 6 is a view illustrating installation of an exemplary lamp post to which the lamp device illustrated in FIG. 1 is installed.

FIG. 1 is a perspective view of a lamp device according to an embodiment of the present invention, FIG. 2 is a frontal view of the lamp device illustrated in FIG. 1, FIG. 3 is a left side view of the lamp device illustrated in FIG. 1, FIG. 4 is a sectional view of the lamp device illustrated in FIG. 3, taken along the line A-A', FIG. 5 illustrates a bottom structure of the lamp device illustrated in FIG. 1, and FIG. 6 is a view illustrating installation of an exemplary lamp post to which the lamp device illustrated in FIG. 1 is installed.

Referring to FIGS. 1 to 6, a lamp device 10 according to an exemplary embodiment of the present invention has a housing 102 that is shaped into an object or animal (in this embodiment a butterfly) having at least one pair of wings. Housing 102 includes a plurality of heat radiation fins 102*a* on a top surface portion thereof. The housing 102 may further have a side surface portion extended along the edges of the top surface portion. An LED substrate 108 (see FIG. 4) is provided on a bottom surface portion of the housing 102. The LED substrate 108 includes a plurality of LEDs arranged in the shape of the wings, for emitting light.

A cover 104 is engaged with the housing 102 over the LED substrate 108, for protecting the LED substrate 108. The cover 104 is formed of a transparent or semi-transparent light-transmitting material so as to pass the light emitted from the LED substrate 108. To further diffuse the light emitted from the LED substrate 108, the cover 104 may be provided with a light diffusion plate structure.

As illustrated in FIG. 4, a gasket 106 may be further provided between the inner circumferential surface of the side surface portion of the housing 102 and the cover in order to seal the LED substrate 108 from the outside air and moisture. In addition, a sealant is injected into the space between the cover 104 and the side surface portion of the housing 108 to render the sealing and fixing of the cover 104 more tight. Engagement between the structure of the cover 104 and the housing 102 may be implemented in various manners, such as engaging the cover 104 with the housing 102 without the gasket 106. The thus-configured lamp device 10 is mounted on top of a lamp post 1 by use of a connection member having an appropriate shape, thereby illuminating a road or the like, as illustrated in FIG. 6.

As illustrated in FIGS. 1 to 6, the housing 102 (and the whole lamp device including the housing 102) of the present invention is shaped into a butterfly, that is, it has wings that may be viewed from above or below. While the lamp device 10 according to this embodiment of the present invention is shaped into a butterfly, the shape may be that of another winged insect or bird, or a winged object, such as an angel or an aircraft.

To achieve good heat radiation effects, light sources (LEDs) that emit heat should be distributed. To this end, a wide housing is needed. However, a simply wide housing is poor in appearance. The housing is shaped into the wings of an animal, an insect, or an object that are familiar to the human being and aesthetically pleasing. The wing shapes of the housing 102 according to the present invention allow the light sources to be arranged at wide intervals. Therefore, heat radiation is distributed over a larger area. Also, the distributed layout of the light sources leads to a uniform flat light source, resembling a fluorescent lamp and giving off less glare. Because the plurality of heat radiation fins 102*a* is formed on the top surface of the housing 102, they may be utilized as a heat radiation plate or heat sink. Therefore, better heat radiation effects may be achieved without using a separate heat sink.

As described above, the wing-shaped housing has positive heat radiation effects, gives reduced glare due to the uniform flat light source, and has a pleasing aesthetic appearance. Hence, all problems encountered with the conventional lamp technology may be overcome.

The wings each may be configured so that they are rotatable and their angles are controllable with use of an additional motorized driver. In this case, the illumination angle may be changed freely.

Meanwhile, there are techniques for enhancing the appearance of a conventional lamp device by adding a structure having a predetermined shape or providing information through the structure. For instance, a structure shaped into an animal, a plant, or the like representing a city may be added to a street lamp. However, these conventional techniques require installation of a structure in addition to an existing street lamp device. Therefore, installation is rather complex and cost increases.

The additional structure is usually installed on or mounted to a lamp post, either above or below the street lamp device. If the structure is above the lamp, the additional structure is not well illuminated by the street lamp device, making it difficult to discern its shape. If the structure is below the lamp, the additional structure hinders illumination of the street lamp device.

In contrast, the lamp device 10 of the present invention itself is shaped to be aesthetically attractive and the lamp is incorporated into the structure itself. Therefore, the above problem encountered with the addition of a structure to a conventional street lamp is overcome.

Another characteristic structure of the present invention related to the plurality of LEDs arranged on the LED substrate 108 is illustrated in detail in FIG. 5. Among the LEDs, a plurality of LEDs 108*a* arranged along the peripheries of the wings has a different color from a main color of the light emitted from a plurality of LEDs arranged inwardly of LEDs 108*a*. For example, the LED substrate 108 may be configured to have white as its main illumination color, while the LEDs 108*a* along the peripheries of the wings may be red. The remaining inner LEDs are configured to emit the main color, white on the whole, although some of them may be in a different color.

Or the LEDs 108*a* may have a different intensity from the intensity of the inner LEDs (for example, the former may be brighter than the latter). The above-described configuration makes the shape of the lamp device according to the present invention distinctive, thus increasing the visibility of the shape and enhancing the outward appearance of the lamp device.

Meanwhile, there are multiple street lamps on a road, but an artificial name is usually given to the road (regardless of the street lamps).

Therefore, a driver or a pedestrian should read a sign plate with a road name on it in order to find out where he or she is. Sometimes, sign plates are difficult to find and road names are written in text on the sign plates. Hence, to read the road names, the driver or the pedestrian should approach the sign plates by a predetermined distance or longer, so that they are in sight. Hence, the road names are not easy to read, especially in the darkness.

If a street lamp is formed into the shape of a distinctive structure, for example, in the shape of a butterfly, and a road is named after the structure, for example, "Butterfly Street," a driver or pedestrian on the road is reminded of its name without having to read street signs in poor light. As the shape such as butterfly is not text, it is visible at a relatively long distance. Also, the shape may have a different color along its periphery, thus being easily visible at night.

Generally, organizations, facilities, or companies use specific designs as their symbols or logos. For instance, for an organization using a bird, for example, an eagle as its symbol, eagle-shaped street lamps are installed in front of the organization so as to act at once as street lamps and as the symbol of the organization.

Figure 7:
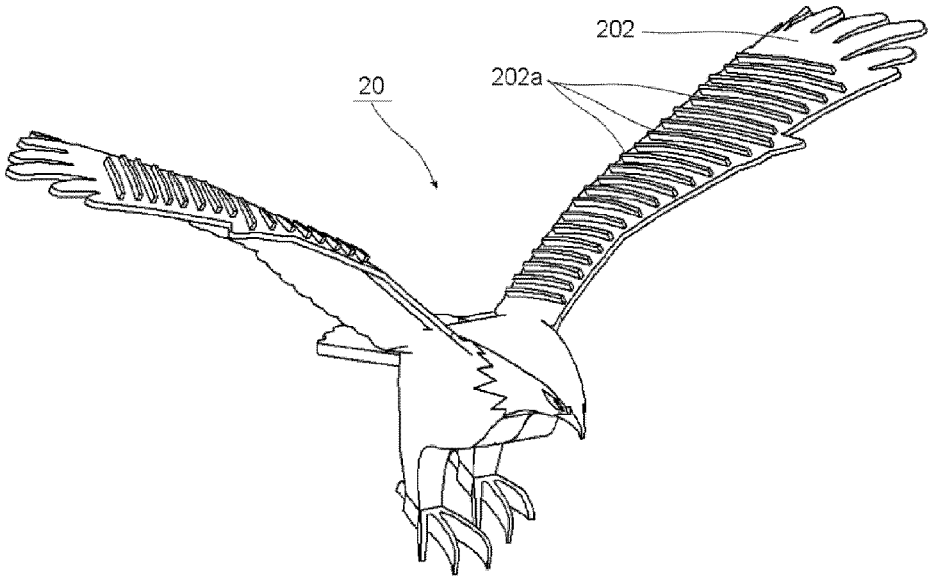
FIG. 7 is a perspective view of a lamp device according to another exemplary embodiment of the present invention.
Figure 8:
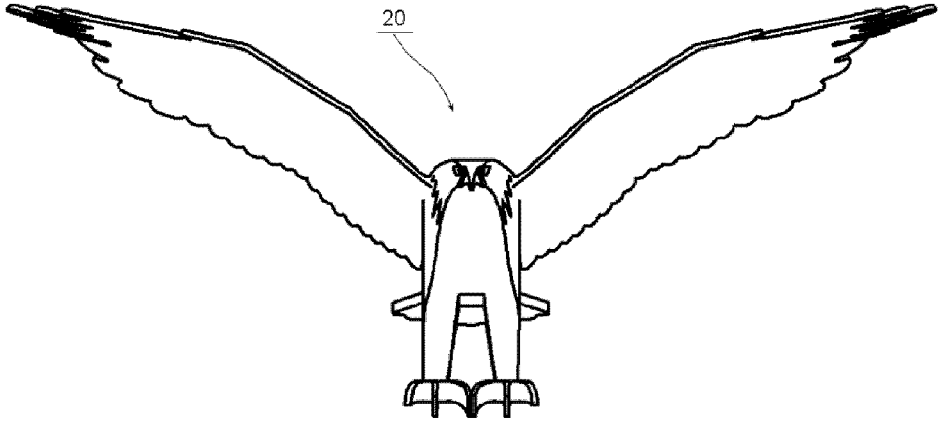
FIG. 8 is a frontal view of the lamp device illustrated in FIG. 7.
Figure 9:
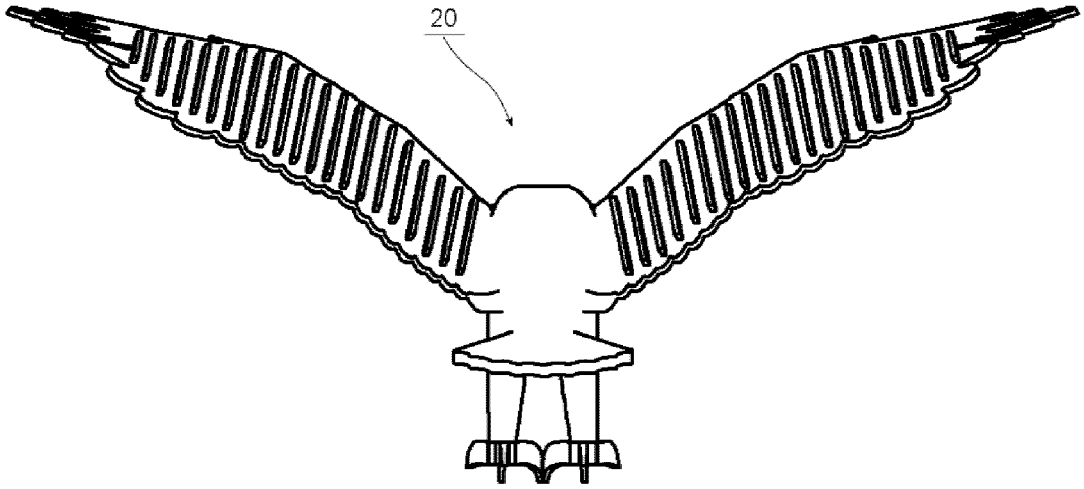
FIG. 9 is a rear view of the lamp device illustrated in FIG. 7.
Figure 10:
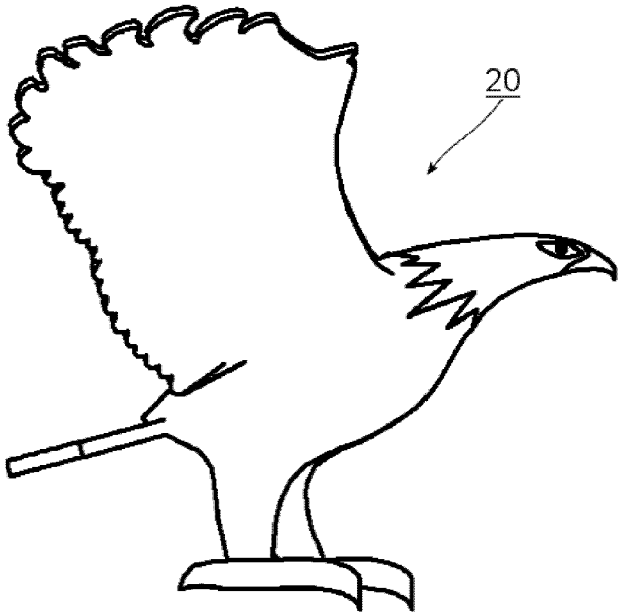
FIG. 10 is a left side view of the lamp device illustrated in FIG. 7.
Figure 11:
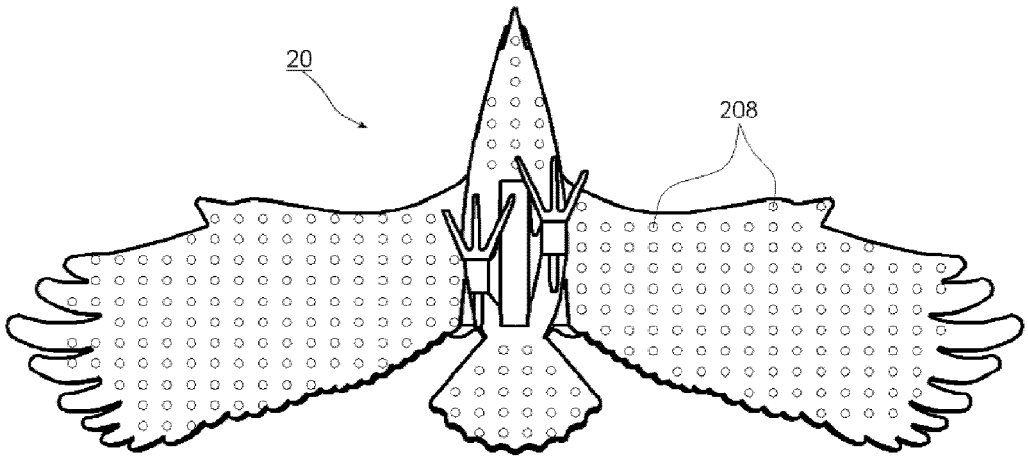
FIG. 11 illustrates a bottom structure of the lamp device illustrated in FIG. 7.
Figure 12:
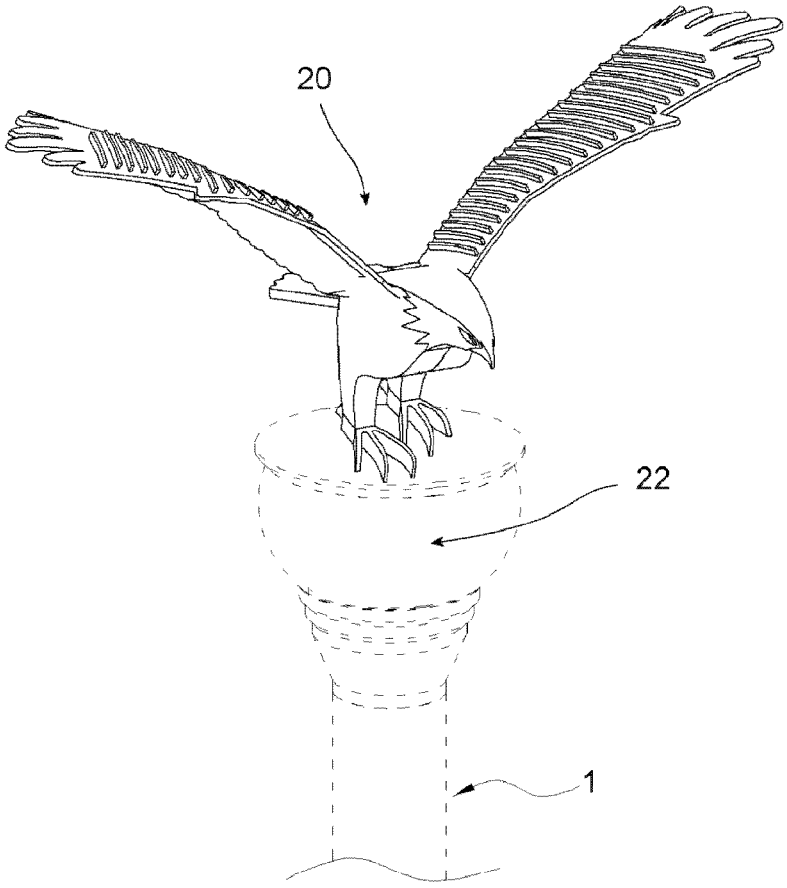
FIG. 12 is a view illustrating installation of an exemplary lamp post to which the lamp device illustrated in FIG. 7 is installed.
Figure 13:
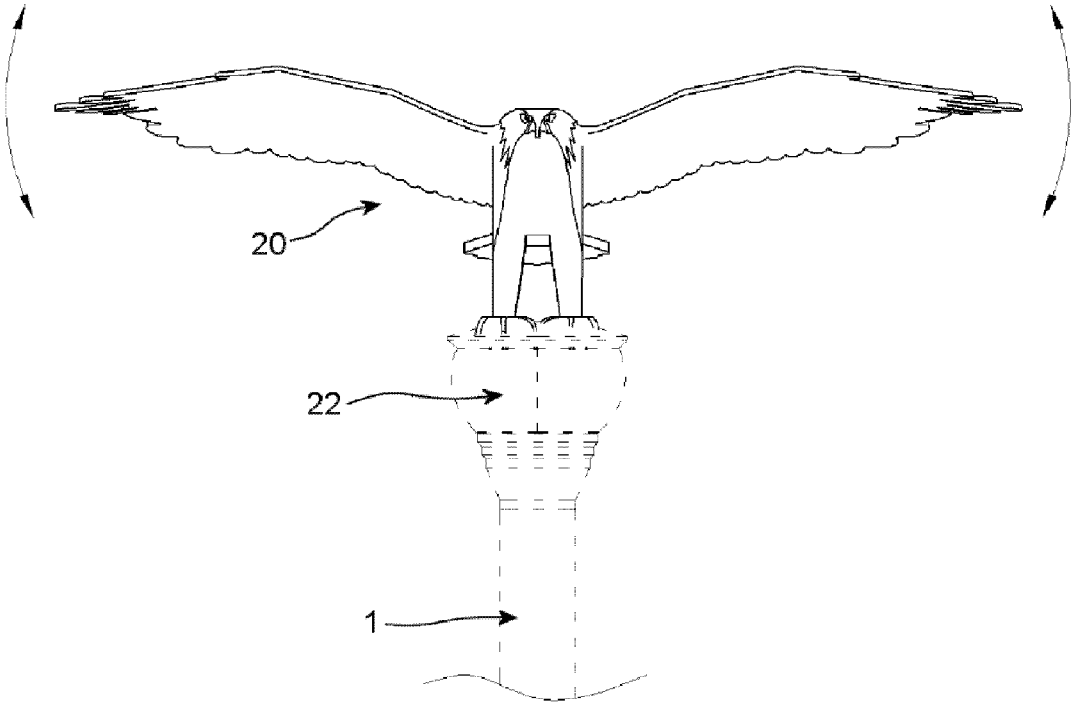
FIG. 13 is a frontal view of the lamp device and the lamp post illustrated in FIG. 12.

FIG. 7 is a perspective view of a lamp device according to another exemplary embodiment of the present invention, FIG. 8 is a frontal view of the lamp device illustrated in FIG. 7, FIG. 9 is a rear view of the lamp device illustrated in FIG. 7, FIG. 10 is a left side view of the lamp device illustrated in FIG. 7, FIG. 11 illustrates a bottom structure of the lamp device illustrated in FIG. 7, FIG. 12 is a view illustrating installation of an exemplary lamp post to which the lamp device illustrated in FIG. 7 is installed, and FIG. 13 is a frontal view of the lamp device and the lamp post illustrated in FIG. 12.

Referring to FIGS. 7 to 13, a lamp device 20 according to a second exemplary or illustrative embodiment of the present invention is shaped into a pair of wings, as in the first embodiment illustrated in FIGS. 1 to 6. The lamp device 20 includes a housing 202 having a plurality of heat radiation fins 202*a* on a top surface portion thereof, for heat radiation, an LED substrate 208 installed under the housing 202, and a cover for protecting the LED substrate 208.

Compared to the lamp device illustrated in FIGS. 1 to 6, in the lamp device 20 illustrated in FIGS. 7 to 13 according to the second embodiment of the present invention, the housing 202 (and the whole lamp device including the housing 202) is shaped into a bird (an eagle in the illustrated case of FIG. 7), not a butterfly. The bird-shaped lamp device 20 according to the second embodiment of the present invention may be provided with LEDs at its tail as well as at its wings.

The head of the lamp device 20 is shaped after the head of the bird and may be formed of a transparent or semi-transparent light-transmitting material. LEDs are additionally provided inside the head of the lamp device 20, to thereby light the head separately.

Similarly to the structure illustrated in FIGS. 1 to 6 according to the first embodiment of the present invention, the bird-shaped lamp device 20 according to the second embodiment of the present invention may be configured such that a plurality of LEDs along the peripheries of the wings (or the tail) are in a different color from the color of a plurality of inner LEDs.

As illustrated in FIGS. 12 and 13, the lamp devices according to the first and second embodiments of the present invention may be installed on a structure of any shape, for example, a spherical structure 22 on top of a lamp post 1, and illuminate a road or the like. The spherical structure 22 is fixed to its underlying lamp post 1 and its overlying the feet of the bird-shaped lamp device 20 by means of a metal or reinforced plastic material on and under the spherical structure 22, thus supporting the lamp device 20. The spherical structure 22 may be formed of a transparent or semi-transparent light-transmitting material on its side surface and may be provided with additional illumination LEDs.

For example, the illumination LEDs are arranged in a generally heptagonal pillar inside the spherical structure 22. LEDs on the respective surfaces of the heptagonal pillar may emit light of different colors (e.g. rainbow colors). Instead of the LEDs, a surveillance camera may be installed inside the spherical structure 22, to monitor the surrounding area. Preferably, a cable is provided to the spherical structure 22 to supply an operation power to the overlying bird-shaped lamp device 20 (through the feet of the bird). Therefore, the spherical structure 22 may be fabricated as an auxiliary module to the bird-shaped lamp device 20. The spherical structure 22 may be formed into any other shape such as a square pillar, a hexagonal pillar, or the like.

Figure 14:
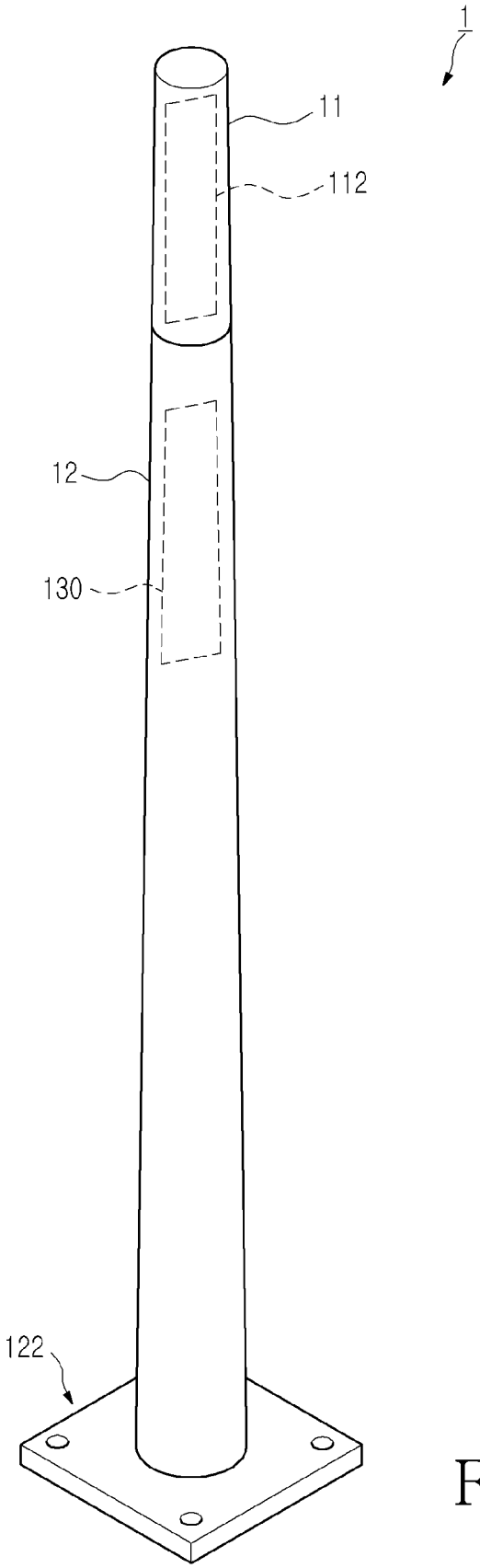
FIG. 14 is an exterior perspective view of the lamp post illustrated in FIG. 6 or 12.

FIG. 14 is an exterior perspective view of the lamp post illustrated in FIG. 6 or 12. With reference to FIG. 14, the structure of the lamp post 1 of the present invention will be described in detail. The pillar-shaped lamp post 1 houses an antenna device 112 for a wireless communication system in its interior. To this end, the lamp post 1 may be divided into an antenna mount 11 on top of the pillar, for installing the antenna device 112 therein, and a support 12 corresponding to a lower portion of the pillar, for fixing the pillar-shaped antenna device on the ground.

At least part of the exterior of the antenna mount 11 may be formed of a material that does not hinder transmission and reception of radio signals. For example, the part of the antenna mount 11 may be formed of the same material as that of a general antenna radome, i.e. a plastic material such as Fiber Reinforced Plastic (FRP), Acrylonitrille Styrene Acrylate (ASA), Poly Vinyl Chloride (PVC), etc.

The exterior of the support 12 is formed of a metal or Fiberglass Reinforced Plastic (FTP). A ground supporting member 122 is formed at a lower portion of the support 12 and may have holes at appropriate positions to receive anchor bolts (not shown) of a pre-formed concrete foundation on the ground. The pillar-shaped support 12 with the ground supporting member 122 may look like a conventional utility pole or the post of a conventional street lamp. The support 12 may include a control module inside it to provide overall control to the operations of the antenna device 112.

While the antenna mount 11 and the support 12 may be fabricated separately and engaged with each other in the lamp post 1 of the present invention, they look like a monolithic or integrated (single-piece) structure when combined. That is, the lamp post 1 of the present invention is similar to a general pole in outward appearance and includes an in-built wireless communication antenna inside the pole.

A wireless transceiver may be installed separately from the lamp post 1 of the present invention as is done conventionally and connected to the lamp post 1. Or the wireless transceiver may be housed or accommodated inside the lamp post 1, for instance, the support 12 according to another embodiment of the present invention. To protect the wireless transceiver against breakage or water-incurring damage, it may be installed at a selected height inside the pillar-shaped support 12. If the wireless transceiver is installed within the pillar-shaped lamp post 1, the wireless transceiver is near to the antenna device, thereby reducing signal loss.

The installation of the antenna device 112 within the lamp post 1 having the street lamp device 20 gives the antenna device 112 the appearance of a typical and conventional street lamp. Therefore, the antenna device 112 is not an unwelcome addition to the environment, but rather friendly in appearance and in harmony with the surroundings, compared to a conventional wireless communication antenna device.

Because a surveillance camera may be additionally installed in the spherical structure 22, it is also disguised and eco-friendly. The surveillance camera is also harmonized with the surroundings without creating the uncomfortable feeling usually associated with surveillance cameras.

Despite the need for installation at an appropriate position for reliable wireless communications and monitoring, the conventional antenna device or surveillance camera is an unwelcome addition to the landscape. Moreover, because street lamps for illuminating roads and surveillance cameras for preventing crimes typically are installed on separate posts in an urban area, multiple unnecessary and disfiguring posts exist in urban areas.

In contrast, the lamp device of the present invention disguises a wireless antenna and a surveillance camera to be invisible aesthetically pleasing. Hence, the conventional problems are overcome and the lamp device of the present invention mitigates the aesthetic drawbacks of conventional lamp, antenna, and surveillance devices.

Because the lamp post 1 of the present invention may be installed on the ground with the antenna device 112 built into it, the installation task is very easy when the lamp post is installed in a flat area and an installation site is easy to find. The lamp post 1 may substitute for an existing street lamp, thereby facilitating securing of power and connection to a communication cable.

A motion sensor, a weather sensor, and an illumination sensor may be added to the lamp post 1 so that the lamp post 1 has a surveillance function according to another embodiment of the present invention.

Lamp devices may be configured according to the embodiments of the present invention, as described above. While the present invention has been described with certain embodiments, many modifications can be made to the present invention within the scope of the present invention. For example, while a lamp device is shaped into a butterfly or a bird (eagle) in the embodiments of the present invention, it may have any other shape like a winged animal or object, with a surveillance camera disguised therein. For example, the lamp device may be shaped into a dragonfly, with a surveillance camera in the head thereof in another embodiment of the present invention.

Figure 15:
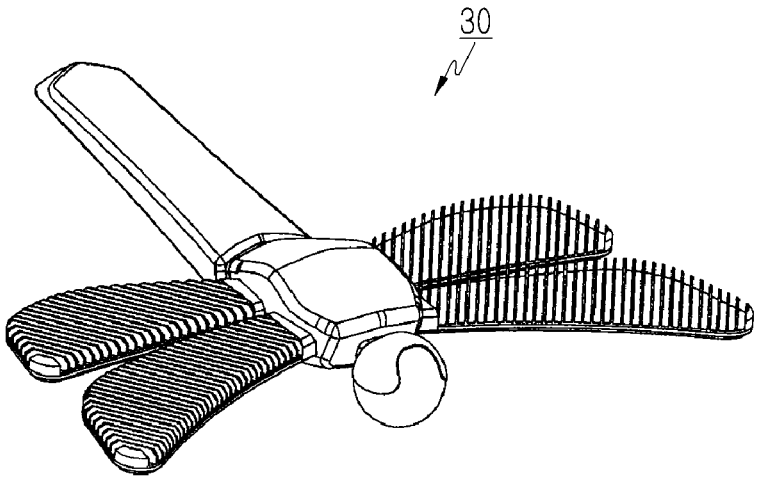
FIG. 15 is a perspective view of a lamp device according to the third embodiment of the present invention.
Figure 16:
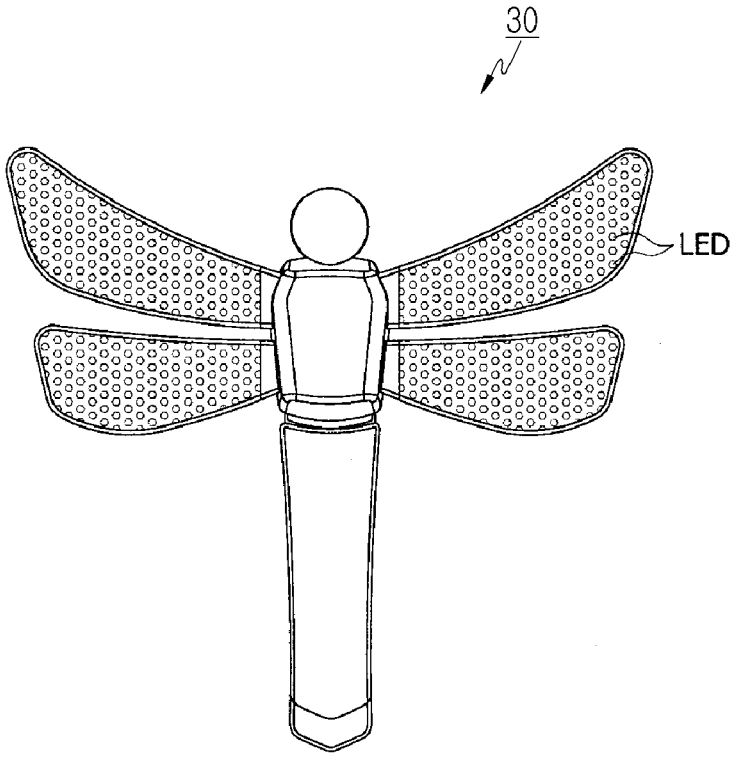
FIG. 16 illustrates a bottom structure of the lamp device illustrated in FIG. 15.

FIGS. 15 through 16 illustrate a lamp device according to a third embodiment of the present invention. This lamp device 30 according to the third embodiment is shaped into a dragonfly. A surveillance camera is installed within the head of the dragonfly.

Figure 17:
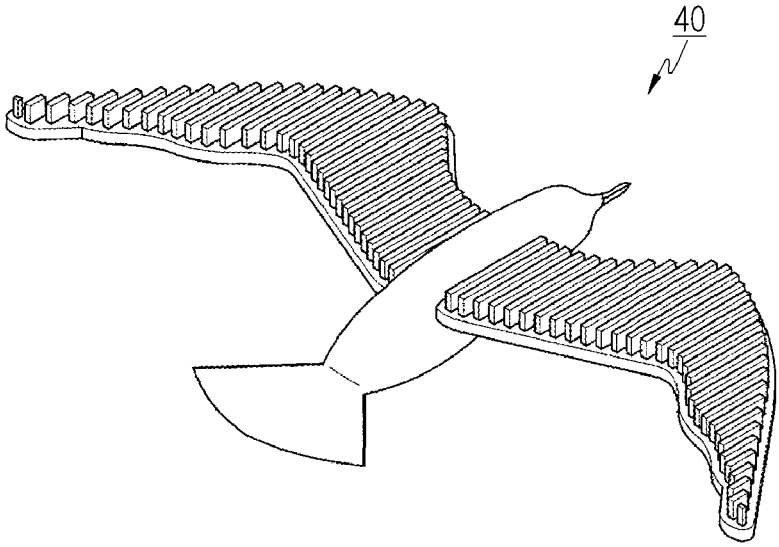
FIG. 17 is a perspective view of a lamp device according to the fourth embodiment of the present invention.
Figure 18:
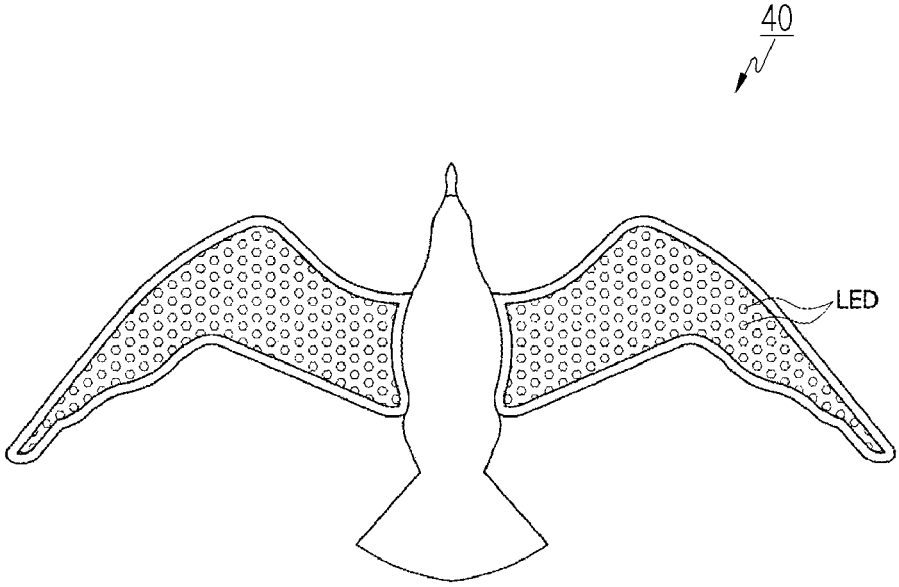
FIG. 18 illustrates a bottom structure of the lamp device illustrated in FIG. 17.

FIGS. 17 and 18 depict a lamp device according to the fourth embodiment of the present invention. This lamp device 40 according to the fourth embodiment is shaped into a sea gull. The surveillance camera is installed within the head of the sea gull. Thus, a lamp device according to the present invention may have any other shape like a winged animal or object.

While it has been described that the spherical structure 22 illustrated in FIGS. 12 and 13 is applied to the second embodiment of the present invention, it may be installed under the lamp device 10 or on the lamp post 1 in the first, third and fourth embodiments of the present invention. The spherical structure 22 may also have any other shape like a flower bud or the like.

While it has been described that the lamp device of the present invention is mainly for outdoor use, such as a street lamp, it may also be used for indoor uses.

Therefore, it will be understood by those skilled in the art that various changes in form and details may be made therein without departing from the spirit and scope of the present invention as defined by the appended claims and their equivalents.

As described above, the lamp device of the present invention has good heat radiation because light sources are distributed across a wide area of a plane and thus heat emission portions are distributed. Also, a uniform fluorescent light source can be generated, thereby reducing glare.

A planar housing with the light sources is provided with heat radiation fins on one surface thereof and the heat radiation fins are used as heat radiation portions. Therefore, excellent heat radiation effects are achieved without additional heat radiation portions.

As the planar housing with the light sources is shaped into the wings of an animal or an insect, it is familiar to people. Thus, it is eco-friendly and looks good.

A plurality of LEDs arranged on the outer circumferential surface of the wings are configured to have a different luminance or color from that of light emitted from a plurality of inner LEDs. Hence, the shape of the lamp device becomes distinctive.

Since the housing is designed into the wings, the illumination angle of light can be changed by adjusting the angle of the wings.

Identity can be given to a specific area by naming a street a butterfly street lamp road.

When the logo of an organization, a facility, or a company is a butterfly, butterfly street lamps are installed in front of the organization, the facility, or the company, so that the street lamps can be utilized as its symbol.

Because a wireless communication antenna device and a surveillance camera can be disguised to be invisible, they reduce uncomfortable feelings that may be caused by their installation.

What is claimed is:

1. A lamp device comprising:

a housing having a side surface portion extending along an edge of a top surface portion and shaped into a structure representing an animal or object with generally horizontally extending wings;

a plurality of fins for heat radiation on a top surface of the wings;

a plurality of light-emitting-diodes LEDs arranged on the wings;

a cover directly engaged with the housing over the LEDs, the cover formed of a light-transmitting material that allows passage of light emitted from the LEDs; and a gasket installed between an inner circumferential surface of the side surface portion of the housing and the cover for sealing the LEDs from outside air.

2. The lamp device of claim 1, wherein the plurality of LEDs includes peripheral LEDs arranged at a periphery of the wings, and inner LEDs arranged inboard of the peripheral LEDs, the peripheral LEDs emitting light having a different color from the inner LEDs.

3. The lamp device of claim 2, wherein a portion of the inner LEDs emit light in a different color from a remainder of the inner LEDs.

4. The lamp device of claim 1, wherein the plurality of LEDs includes peripheral LEDs arranged at a periphery of the wings, and inner LEDs arranged inboard of the peripheral LEDs, the peripheral LEDs emitting light having an intensity from the inner LEDs.

5. The lamp device of claim 1, further comprising an LED substrate to which the plurality of LEDs are mounted, the LED substrate having an area corresponding to at least the wings of the housing.

6. The lamp device of claim 1, wherein the wings of the housing are rotatable.

7. The lamp device of claim 1, wherein the lamp device is installed on top of a lamp post by a spherical structure.

8. The lamp device of claim 7, wherein the spherical structure is formed of a light-transmitting material on a side surface of the spherical structure and has a light inside.

9. The lamp device of claim 7, wherein a surveillance camera is installed within the spherical structure, for monitoring a surrounding area.

10. The lamp device of claim 1, wherein the lamp device is installed on top of a lamp post; and the lamp post is shaped generally into a pillar and includes an upper portion of the pillar for installing an antenna device in its interior, and a lower portion of the pillar, for fixing the lamp post on the ground, wherein at least an exterior portion of the upper portion of the pillar is formed of a material that passes radio transmission and reception signals and a ground support member is formed at a lower portion of the pillar, so that the support stands vertically on the ground.

11. The lamp device of claim 1, wherein the structure represents one of butterfly, sea gull, dragonfly, and eagle shapes.

12. The lamp device of claim 1, wherein the structure represents a bird having head and tail portions and the LEDs are arranged on the head and tail portions.

13. The lamp device of claim 12, wherein the head portion of the structure is shaped into the head of a bird and formed of a light-transmitting material and a portion of the housing engaged with the head portion of the structure is provided with an LED to separately illuminate the head portion of the structure.

14. The lamp device of claim 12, wherein the lamp device shaped into the structure representing a bird is installed on top of a lamp post by a spherical or structure.

15. The lamp device of claim 14, wherein the spherical structure is formed of a light-transmitting material on a side surface of the spherical structure and has an illumination light inside.

16. The lamp device of claim 14, wherein a surveillance camera is installed within the spherical structure, for monitoring a surrounding area.

17. The lamp device of claim 12, wherein the lamp device is installed on top of a lamp post, and the lamp post is generally shaped into a pillar and includes an antenna mount formed at an upper portion of the pillar, for installing an antenna device, and a support formed at a lower portion of the pillar, for fixing the lamp post on the ground, wherein at least an exterior part of the antenna mount is formed of a material that passes radio transmission and reception signals and a ground support member is formed at a lower portion of the support, so that the support stands vertically on the ground.

* * * * *